United States Patent [19]

Takahashi et al.

[11] Patent Number: 4,806,029

[45] Date of Patent: Feb. 21, 1989

[54] CARRIAGE DRIVE UNIT FOR AVOIDING A LOSS TIME PERIOD IN A PRINTER

[75] Inventors: Kiyoshi Takahashi; Haruyuki Shimomura; Masaru Mizuno, all of Nagoya, Japan

[73] Assignee: Brother Kogyo Kabushiki Kaisha, Aichi, Japan

[21] Appl. No.: 136,543

[22] Filed: Dec. 22, 1987

[30] Foreign Application Priority Data

Jan. 22, 1987 [JP] Japan ..... 62-13846

[51] Int. Cl.[4] ..... B41J 19/50

[52] U.S. Cl. ..... 400/144.2; 400/322

[58] Field of Search ..... 400/322, 157.2, 144.2, 400/279, 328, 319, 320, 320.1

[56] References Cited

U.S. PATENT DOCUMENTS 3,994,381 11/1976 Hebert ..... 400/124
4,134,692 1/1979 Suzuki et al. ..... 400/144.2
4,710,043 12/1987 Matsushita ..... 400/322 X

FOREIGN PATENT DOCUMENTS 0205778 11/1983 Japan ..... 400/322
61-35976 2/1986 Japan .
1338675 11/1973 United Kingdom .
2016769 9/1979 United Kingdom .

OTHER PUBLICATIONS

IBM Technical Disclosure, "Control Algorithm for Improved Print Registration", vol. 28, No. 10 (Mar. 1986) pp. 4386–4390.

*Primary Examiner*—Edgar S. Burr
*Assistant Examiner*—James Lisehora
*Attorney, Agent, or Firm*—Parkhurst, Oliff & Berridge

[57] ABSTRACT

A carriage drive unit for a printer includes a typewheel and a printing hammer for striking a type element of the typewheel against a ribbon to reproduce the type element on a printing paper, both of which are provided on a carriage. The carriage is driven by a carriage drive motor in response to a drive control signal SG2 output by a CPU, before the printing hammer, which is driven by a hammer drive motor in response to a drive control signal SG5, reaches a printing position, for avoiding a loss time period due to a carriage response delay upon a start of the carriage drive motor.

10 Claims, 5 Drawing Sheets

CARRIAGE DRIVE UNIT FOR AVOIDING A LOSS TIME PERIOD IN A PRINTER

BACKGROUND OF THE INVENTION

1. Field of the Invention

The present invention relates to a carriage drive unit for a printer, and in particular, to a carriage drive unit for a printer having, on a carriage, a typewheel and a printing hammer for striking the typewheel, and controlling transfer timing of the carriage in accordance with a strike of the printing hammer.

2. Prior Art

Prior to the present invention, in such a printer, transfer timing of a carriage is determined, when a printing hammer for striking a typewheel reaches a printing position, that is, an operation position where the printing hammer abuts a printing paper on a platen via a printing ribbon and a type element of a typewheel, by output of a drive control signal to a motor drive circuit for driving a carriage drive motor in order to transfer the carriage by a character to print the next character. Further, in such a printer, the difference of the impact force of the printing hammer in accordance with each area of characters brings about the difference of the reach time period Th in FIG. 6 which covers from the initial drive movement of the printing hammer until reaching the printing position.

Paying attention to the above point, Published Unexamined Patent Application No. sho 61-35976 discloses a printer which can determine the reach time period Th of a carriage to a printing position by associating the transfer timing thereof with each area of characters, that is, the difference of the impact force, and also shorten the stationary time of the carriage to increase a printing speed.

However, as shown in FIG. 6, even if a drive control signal SG2 is entered to drive a carriage drive motor at the same time when a printing hammer reaches the printing position from a waiting position in response to a drive control signal SG5 to drive the printing hammer, load and transmission loss of a drive force in a drive system for the carriage drive motor delay the starting of the carriage in the right direction by a constant time t1 after output of the drive control signal SG2. The response delay time period t1 prevents the printing speed from being increased.

SUMMARY OF THE INVENTION

It is an object of the present invention to provide a carriage drive unit for a printer which can shorten the stationary time to thereby increase a printing speed.

In accordance with the present invention, a carriage drive unit for a printer comprising; a printing hammer for striking a typewheel toward a printing paper which is set on a platen; hammer driving means for driving the printing hammer; a carriage for being bi-directionally transferred in a longitudinal direction along the platen, the typewheel and the printing hammer being provided on the carriage; carriage driving means for driving the carriage; and control means for outputting a first drive control signal to the carriage driving means before the printing hammer reaches a printing position in order to avoid a loss time period due to a carriage response delay upon a start of the carriage drive means.

In view of the above, when the printing hammer is driven by the hammer drive means, the control means outputs the drive control signal to the carriage drive means before the printing hammer reaches the printing position by considering the carriage response delay due to the load and the transmission loss on the start of the carriage drive means. Accordingly, the carriage driven by the carriage drive means is transferred right after the printing hammer reaches the printing position.

BRIEF DESCRIPTION OF THE DRAWINGS

Other objects and features of the invention will become apparent to those skilled in the art as the disclosure is made in the following invention, as illustrated on the accompanying sheets of drawings, in which.

DETAILED DESCRIPTION OF THE PREFERRED EMBODIMENT

Hereinafter, the preferred embodiment of the present invention will be described in detail with reference to the drawings.

Figure 1:
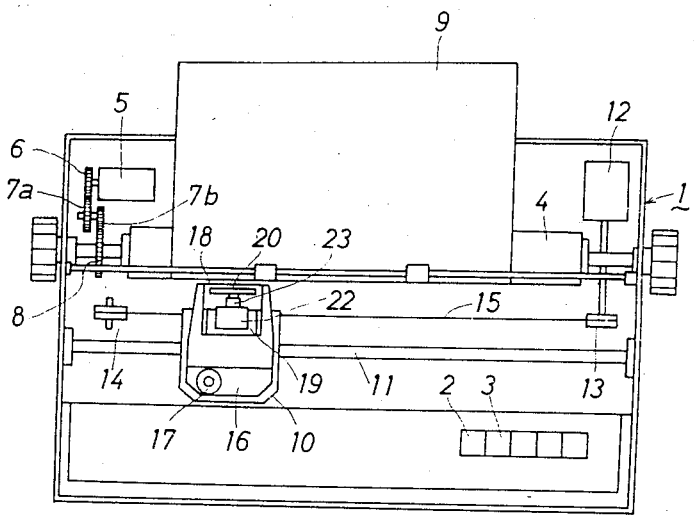
FIG. 1 is a plan view of a printer embodying the present invention.

Referring now to FIG. 1, there is shown a printer 1, in which in the front are provided a printing pitch selector key 2 for selecting one out of three printing pitches, that is, pica (10 characters per inch), elite (12 characters per inch) and micron (15 characters per inch), and a start key 3. whenever the printing pitch selector key 2 is depressed, the three printing pitches, namely, pica, elite and micron, are changed in cycles. A platen 4 is rotatably supported around a frame. At the left back of the platen 4, is provided a line feed stepping motor (LF motor) 5. The platen 4 is connected to the LF motor 5 via gears 6, *7a*, *7b* and 8, and rotated in response to driving of LF motor 5 to guide a printing paper 9, which is set on the platen 4.

In front of the platen 4, is provided a carriage 10, which is movable and supported by a guide rail 11, arranged parallel to the platen 4. At the right back of the platen 4, is provided a carriage drive stepping motor (CA motor) 12 as a carriage drive means. The CA motor 12 includes a drive shaft at the end of which a pulley 13 is fixed. At the opposite side of the pulley 13, is a pulley 14, and a wire rope 15 is coupled with therebetween. The carriage 10 is connected to a part of the wire rope 15. Accordingly, the carriage 10 is connected to the CA motor 12 via the wire rope 15 and the pulley 13, and bi-directionally transferred along the guide rail 11 in accordance with clockwise or counterclockwise rotation of the CA motor 12.

A ribbon cartridge 16 which stores a printing ribbon 18 is placed on the carriage 10. The printing ribbon 18 is taken up character by character by a ribbon take-up motor (ribbon motor) 17 whenever a character is printed. A character selection stepping motor (WH motor) 19 is also placed on the carriage 10. A typewheel (daisy wheel) 20, which includes a plurality of spokes 20*a*, each having a type element 21 at the end thereof, is held on the drive shaft of the WH motor 19 which spins the typewheel 20 to guide an appropriate type element 21 to a strike position.

Figure 2:
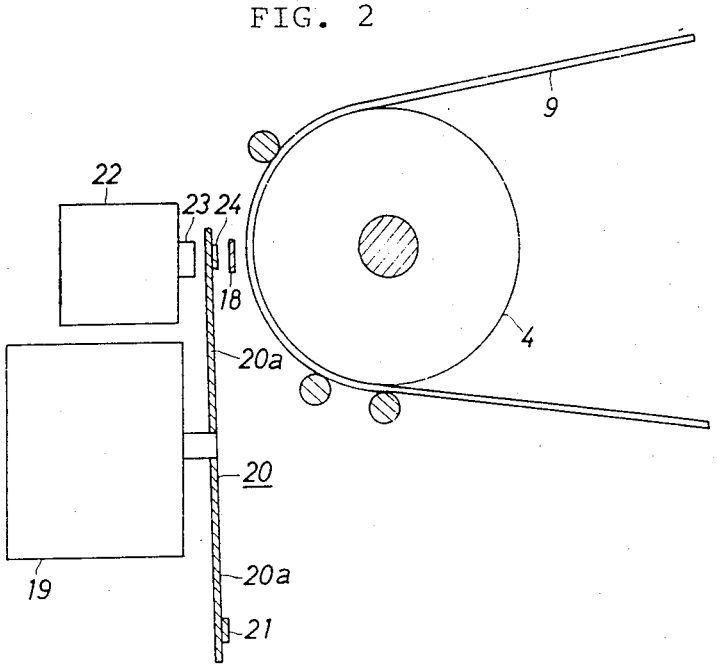
FIG. 2 is a side view showing the vicinity of the printing hammer at the waiting position.
Figure 3:
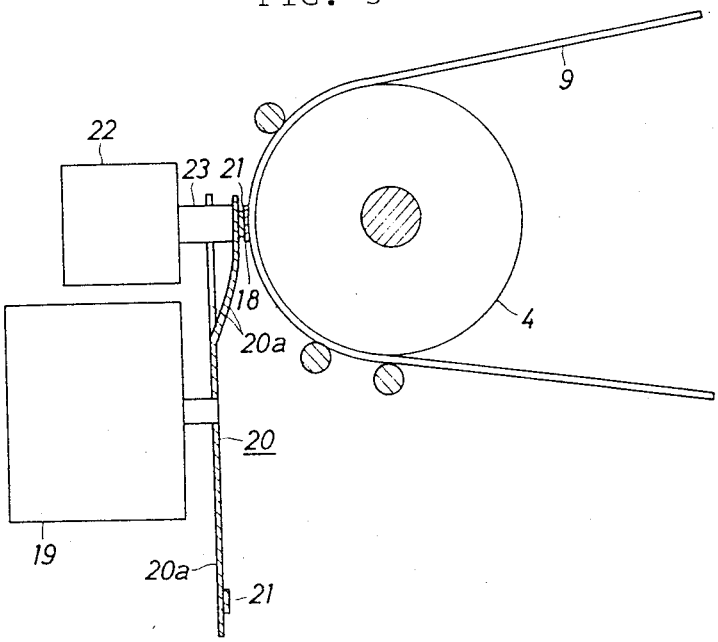
FIG. 3 is a side view showing the vicinity of the printing hammer at the printing position.
Figures 5A, 5B, 5C, 5D, 5E, 5F, 5G, 5H:
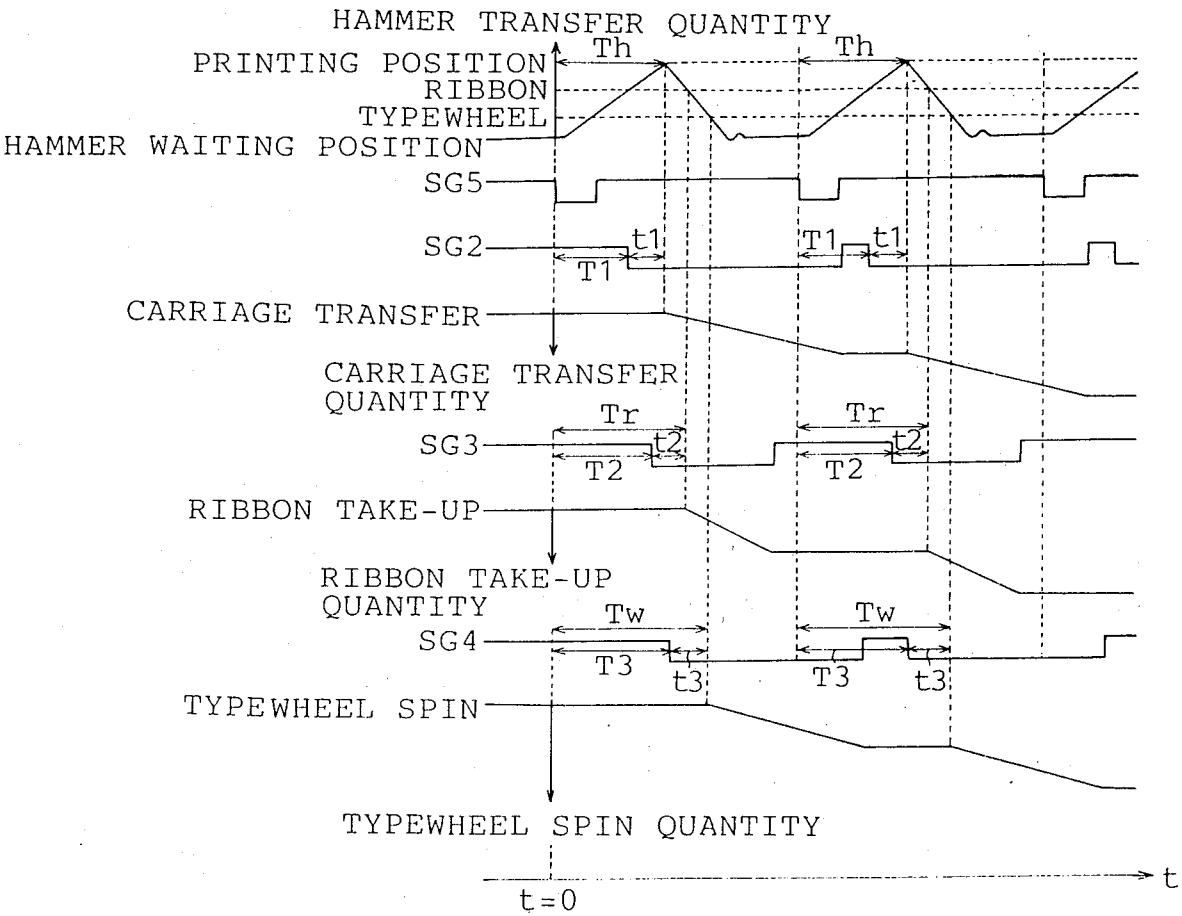
FIGS. 5A–5H are graphs showing the relation between printing hammer transfer, carriage transfer, ribbon take-up and typewheel spin quantities, and drive control signals SG2 through SG5, according to the time.
Figure 6:
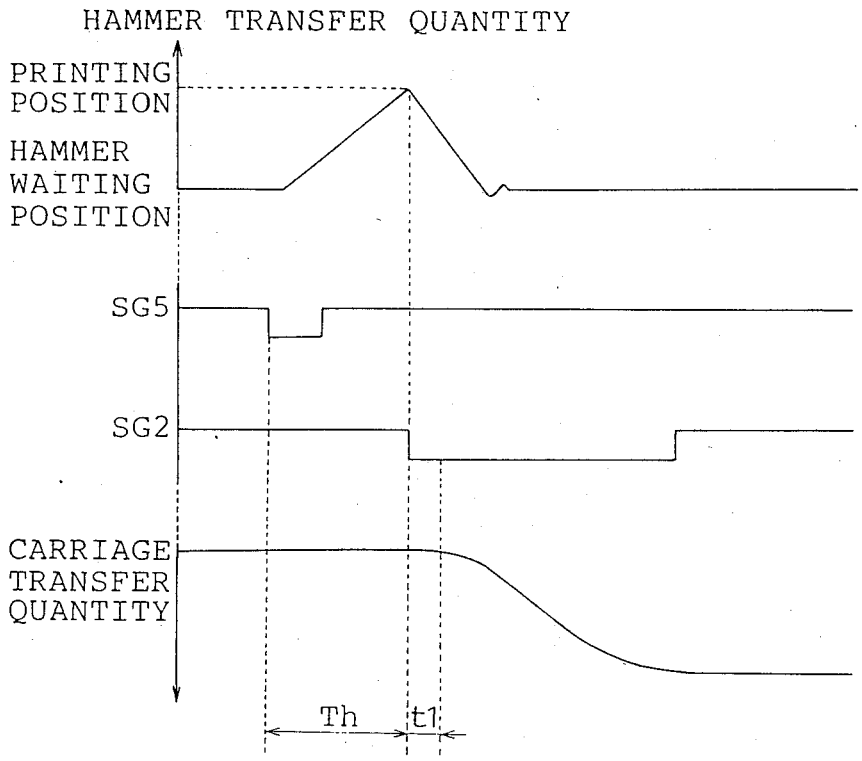
FIG. 6 PRIOR ART
FIG. 6 is a view showing the relation between hammer transfer quantity of the conventional printing hammer and a carriage drive signal.

Just above the WH motor 19, is an electromagnetic solenoid 22 as a hammer drive means which is fixed on the carriage 10 and actuates a printing hammer 23. The printing hammer 23 strikes the type element 21 of the typewheel 20 against the platen 4 at the strike position. As shown in FIG. 2, the solenoid 22 always maintains the printing hammer 23 at a waiting position with the help of a spring (not shown). However, once the solenoid 22 is energized, the printing hammer 23 is pushed out against elasticity of the spring to strike the type element 21 of the typewheel 20. FIG. 5A shows the printing hammer transfer quantity according to the time. As shown in FIG. 3, when the printing hammer 23 is pushed out farthest, namely, when the printing hammer 23 reaches a printing position, the type element 21 reaches the printing paper 9 via the ribbon 18 to print a character corresponding to the type element 21 of the typewheel 20.

In this embodiment of the present invention, impact force of the printing hammer 23 against the typewheel 20 is available in two types according to the type element 21. The impact force is controlled by the pulse width of a hammer drive control signal SG5 which is entered to a hammer drive circuit 38 from a central processing unit 31(CPU), which will be treated later.

An electronic structure of the printer 1 will hereinafter be described in detail.

Figure 4:
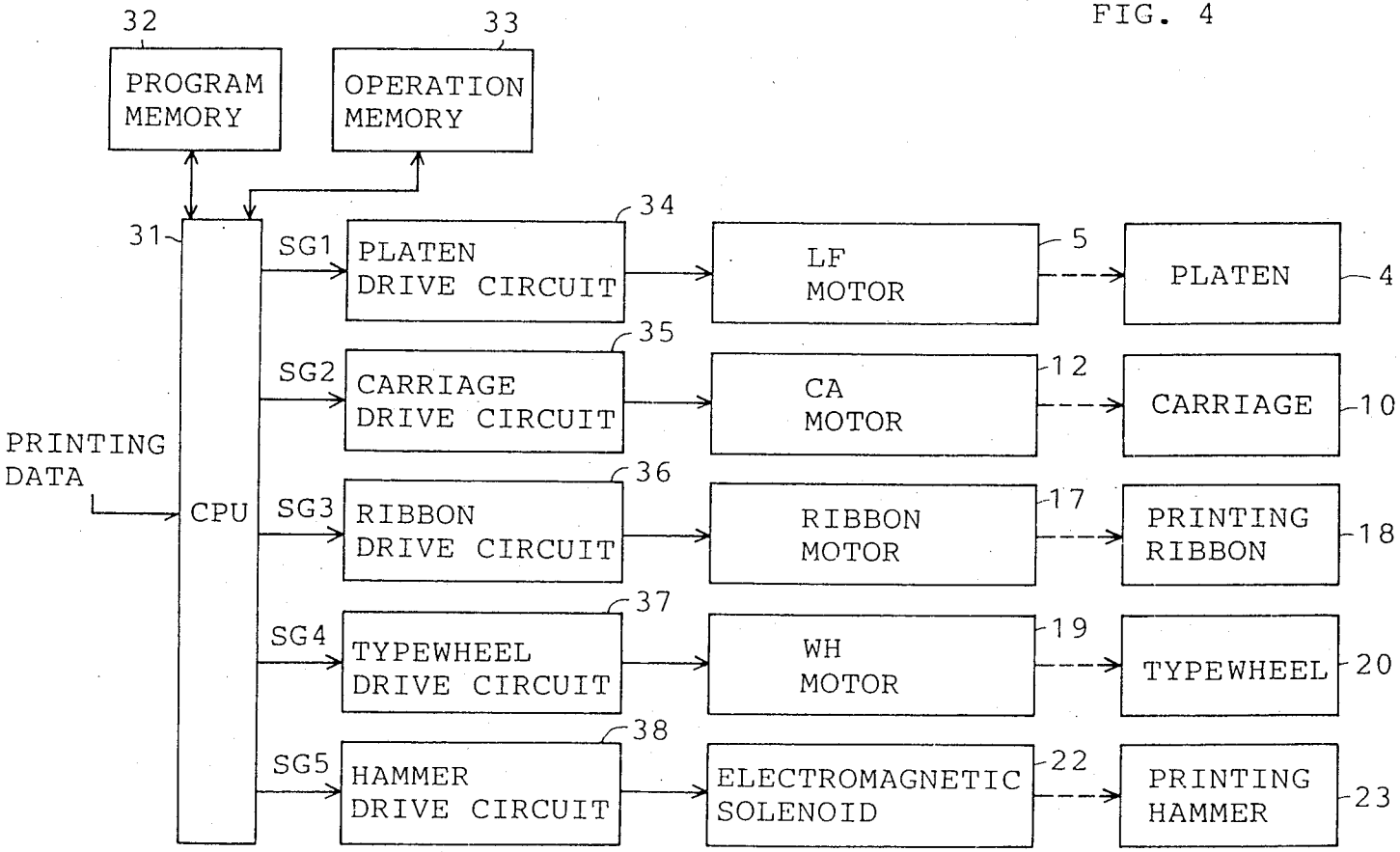
FIG. 4 is a block circuit diagram showing an electronic construction of the printer.

Referring to FIG. 4, the CPU 31 includes, as a control means, a program memory 32 which has a read only memory (ROM), and an operation memory 33 which has a random access memory temporarily storing printing data sent from an external device (not shown) and the calculated results of the data, outputting drive control signals SG1 through SG5 to the respective drive circuits 34 through 38 for respectively driving the motors 5, 12, 17, 19 and the electromagnetic solenoid 22. Thus, the type element 21, which corresponds to the printing data read out from the operation memory 33 in accordance with a control program stored in the program memory 32, is printed on a predetermined position of the paper 9.

In other words, after reading out the printing data, the CPU 31 outputs the signal SG4 which changes from plus potential (high level) to zero level (low level), to the typewheel drive circuit 37 for driving the WH motor 19, thereby allowing the type element 21 corresponding to the printing data to be set to the strike position. Sequentially, the CPU 31 outputs the signal SG5 which changes from high to low levels, to the hammer drive circuit 38 for energizing the solenoid 22, thereby allowing the printing hammer 23 to strike the type element 21 at the strike position.

The signal SG4 indicates the spin direction and the spin quantity of the WH motor 19, which are required for transferring the desired type element 21 from a current position to a strike one. The CPU 31 calculates the spin direction and the spin quantity of the WH motor 19 in accordance with relative position data of each type element 21 of the typewheel 20 beforehand stored in the program memory 32, and current position data of the type element 21 being located at the strike position before spin, stored in the operation memory 33. The signal SG5 is generated as the calculated result.

The signal SG5 sent to the hammer drive circuit 38 includes a signal indicating whether the impact force of the printing hammer 23 should be heavy or light, in response to the type element 21 at the strike position which is selected in accordance with the printing data. The CPU 31 outputs the signal SG5 in accordance with data of the impact forces for each of the type elements 21 beforehand stored in the program memory 32.

As shown in FIGS. 5A through 5D, after outputting the signal SG5, the CPU 31 also outputs the signal SG2 which changes from high to low levels, to the carriage drive circuit 35 for driving the CA motor 12, thereby allowing the carriage 10 to be transferred by a pitch after a lapse of the predetermined time (start time period) T1 from the time when the signal SG5 becomes low level. The start time period T1, or the timing of the signal SG2 output to the drive control circuit 35, is shorter than the time (reach time period) Th which the printing hammer 23 takes to reach the printing position shown in FIG. 3 from the waiting position. The start time period T1 is represented as Th−t1, where t1 denotes the time (loss time period) taking from the output of the signal SG2 to starting of the carriage 10 due to load and transmission loss of the CA motor 12. The reach time period Th varies with the impact force of the printing hammer 23, namely, 'heavy' or 'light', therefore, the reach time period Th should be obtained prior to beginning by experiment or calculation in the both cases of heavy and light impact forces in order to store the obtained results in the program memory 32. On the other hand, without being subject to the impact force, the loss time period t1 varies with the printing pitch such as pica (1/10 inch pitch), elite (1/12 inch pitch) or micron (1/15 inch pitch), each loss time period t1 of which should be obtained prior to beginning by experiment or calculation to store the obtained results in the program memory 32.

In this embodiment of the present invention, when the impact force is heavy, the reach time period Th is 5.0 m sec. On the other hand, when it is light, the reach time period Th is 6.0 m sec. Further, the loss time periods t1 with pica, elite and micron pitches are 2.0 m sec., 1.5 m sec. and 1.5 m sec., respectively.

Accordingly, the CPU 31 can properly read out the reach time period Th and the loss time period t1 from the program memory 32 respectively according to 'heavy' or 'light' of the impact force and to each of printing pitches in order to calculate the start time period $T1(=Th-t1)$. A timer built in the CPU 31 counts the time from output of the signal SG5 to a start point of the start time period T1 so that the CPU 31 may determine the output time of the signal SG2 and continue outputting it while the carriage 10 is transferred by a pitch in response to the printing pitch beforehand stored in the program memory 32.

In this embodiment of the present invention, as shown in FIGS. 5E through 5H, for the next printing, take-up start time period T2 of the ribbon 18, and spin start time period T3 of the typewheel 20 are respectively obtained for setting the type element 21 to the strike position according to the next printing data, by considering the loss time periods t2 and t3 respectively taking from the output of the signals SG3 and SG4 to the transfer starting of the ribbon 18 and the typewheel 20 due to load or transmission loss of the ribbon motor 17 and the WH motor 19. In other words, the take-up start time period T2 is represented as Tr−t2, where Tr denotes a separate time period which the end of the printing hammer 23 (to be exact, the type element 21) takes to separate from the ribbon 18 while the printing hammer 23 returns to the waiting position after reaching the printing position and t2 the loss time period. Further, the spin start time period T3 is represented as Tw−t3, where Tw denotes a separate time period which the end of the printing hammer 23 takes to separate from the typewheel 20 while the printing hammer 23 returns to the waiting position from the reach position, and t3 the loss time period.

These both separate time periods Tr and Tw vary with the impact force, that is, 'heavy' or 'light', without being subject to the printing pitch, and are obtained by experiment or calculation according to the impact forces to beforehand store the obtained results in the program memory 32. In this embodiment of the present invention, when the impact force is heavy, the separate time periods Tr and Tw are 5.6 m sec., and 9.0 m sec., respectively. On the other hand, when the impact force is light, the separate time periods Tr and Tw are 8.3 m sec. and 11.5 m sec., respectively. In addition, without being subject to the impact force, the loss time periods t2 and t3 are 1.0 m sec. and 0.5 m sec., respectively. The CPU 31 counts both the start time periods T2 and T3 with the built-in timer, to output the signals SG3 and SG4 to the drive circuits 36 and 37, respectively.

Described below is the detailed operation of the printer 1.

When the pica pitch mode is indicated by the printing pitch selector key 2 and printing data for a line are entered under the condition that the start key 3 is depressed, the CPU 31 temporarily stores the data, and reads out the data to be printed first for calculating the spin direction and spin quantity of the WH motor 19 to set the type element 21 of the typewheel 20 corresponding to the data from the current position to the strike one. Since this is the first printing and the typewheel 20 is initialized, the spin direction and the spin quantity of the WH motor 19 are calculated in accordance with the current position data of the type elements 21 based on the initialized typewheel 20 and the relative position data thereof stored in the program memory 32.

Moreover, the CPU 31 reads out the reach time period Th corresponding to 'heavy' or 'light' of the impact force, and the loss time period t1 of the pica pitch from the program memory 32 according to the printing data in order to calculate the start time period $T1(=Th-t1)$, the take-up start time period $T2(=Tr-t2)$ and the spin start time period $T3(=Tw-t3)$.

The CPU 31 outputs the signal SG4 to drive the WH motor 19 in accordance with the spin direction and the spin quantity for setting the desired type element 21 to the strike position, sequentially outputting the signal SG5 which changes from high to low levels, to the hammer drive circuit 38. At this time, not only is the impact force against the type element 21 to be stricken determined whether it is heavy or light but the signal indicating the determined impact force is output. For example, if the electromagnetic solenoid 22 is energized according to the signal SG5 so that the impact force may be heavy, the printing hammer 23 is immediately so driven as to strike the type element 21 at the strike position.

The CPU 31 drives the timer to count the start time periods T1, T2 and T3 in response to the signal SG5 down to low level. After a lapse of the start time period T1 from the time when the signal SG5 becomes low level, the CPU 31 immediately outputs the signal SG2 to the carriage drive circuit 35 to drive the CA motor 12. Although the CA motor 12 directly starts, the carriage 10 can not immediately advance due to the load and the transmission loss of the CA motor 12. In other words, the carriage 10 starts advancing after the loss time period T1, or immediately after the printing hammer 23 reaches the printing position.

After a lapse of the start time period T2 from the time when the signal SG5 becomes low level, the CPU 31 directly outputs the signal SG3 to the ribbon drive circuit 36 to drive the ribbon motor 17. Although the ribbon motor 17 directly starts driving, the ribbon 18 can not immediately be taken up due to the load and the transmission loss of the ribbon motor 17. In other words, the ribbon 18 is taken up after the loss time period t2, namely, when the type element 21 separates from the ribbon 18 while the printing hammer 23 returns to the waiting position.

Further, after a lapse of the start time period T3 from the time when the signal SG4 becomes low level, the CPU 31 immediately outputs the signal SG4 to the typewheel drive circuit 37 to drive the WH motor 19. Similarly to the above, this signal SG4 is output in accordance with the spin direction and the spin quantity of the WH motor 19 to set the selected type element 21 to the strike position according to a new printing data.

When the carriage 10 is transferred by a pitch, the same operation as above is repeated and printing data for a line are printed in accordance therewith.

In this embodiment of the present invention, thus, considering the transfer delay of the carriage 10, or the loss time period t1 due to the load or the transmission loss of the CA motor 12, the signal SG2 is output to the CA motor 12 before the printing hammer 23 reaches the printing position, resulting in that the carriage 10 can be transferred just after the printing hammer 23 reaches the printing position. The carriage 10 can be transferred to the next printing position faster than the conventional one by the loss time period t1. In other words, the stationary time of the carriage 10 can be decreased to increase the printing speed.

The reach time period Th of the printing hammer 23 from the waiting position to the printing one is determined by the value according to the impact force of the printing hammer 23, and the loss time period t1 by the value according to the printing pitch, in order to calculate the start time period T1. Therefore, an efficient printing is executed speedily without being subject to the difference of the impact force or of the printing pitch.

In this embodiment of the present invention, the ribbon motor 17 and the WH motor 19 are driven earlier by considering the loss time periods t2 and t3 due to the load and the transmission loss of the ribbon motor 17 and the WH motor 19, which prevents the printing speed from decreasing due to the operation delay of the ribbon 18 and the typewheel 20.

Further, in this embodiment, the present invention is for a printer which prints according to printing data sent from the external device, however, it may be applied to an electronic typewriter which can store printing data by a line or more, and print the data on the paper at a time according thereto. In addition, it may be applied to a printer which has a six-step impact force by setting the standard value of the whole impact force as a three-step changeover.

Obviously, many modifications and variations of the present invention are possible as pointed out with regards to the above revelations. It is therefore to be understood that within the scope of the appended claims, the invention may be practiced otherwise than as specifically described.

What is claimed is:

1. A carriage drive unit for a printer comprising;

a printing hammer for striking a typewheel toward a printing paper which is set on a platen;

hammer driving means for driving the printing hammer;

a carriage for being bi-directionally transferred in a longitudinal direction along the platen, the typewheel and the printing hammer being provided on the carriage;

carriage driving means for driving the carriage; and means to avoid a loss time period due to a carriage response delay to a start of carriage drive means signal including control means outputting a first drive control signal to the carriage driving means before the printing hammer reaches a printing position.

2. The carriage drive unit for the printer according to claim 1 wherein the control means includes means to determine a start time period of the first drive control signal in response to the loss time period and a predetermined reach time period in which the printing hammer is transferred from a waiting position to the printing position.

3. The carriage drive unit for the printer according to claim 2 wherein the start time period is equal to the predetermined reach time period minus the loss time period.

4. The carriage drive unit for the printer according to claim 1 wherein the control means includes a timer for counting the start time period in response to the second drive control signal.

5. The carriage drive unit for the printer according to claim 1 including means to determine the loss time period in response to a printing pitch.

6. The carriage drive unit for the printer according to claim 2 including means to determine the reach time period in response to an impact force of the printing hammer.

7. The carriage drive unit for the printer according to claim 1 wherein a carriage drive motor and a carriage drive circuit are used as the carriage drive means.

8. The carriage drive unit for the printer according to claim 1 wherein an electromagnetic solenoid and a hammer drive circuit are used as the hammer drive means.

9. The carriage drive unit for the printer according to claim 1 wherein the control means further comprises second control means for outputting a third drive control signal for a ribbon driving means before the printing hammer parts from the printing ribbon for avoiding a loss time period due to ribbon take-up response delay.

10. The carriage drive unit for the printer according to claim 1 wherein the control means further comprises third control means for outputting a fourth drive control signal for printing wheel driving means before the printing hammer parts from the typewheel for avoiding a loss time period due to the typewheel response delay.

* * * * *